US009938043B2

(12) United States Patent
Chasteen et al.

(10) Patent No.: US 9,938,043 B2
(45) Date of Patent: Apr. 10, 2018

(54) CONTAINER END CLOSURE WITH A SCORE FEATURE

(71) Applicant: Ball Corporation, Broomfield, CO (US)

(72) Inventors: Howard C. Chasteen, Westminster, CO (US); Anthony J. Scott, Westminster, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 514 days.

(21) Appl. No.: 14/549,078

(22) Filed: Nov. 20, 2014

(65) Prior Publication Data

US 2015/0136776 A1 May 21, 2015

Related U.S. Application Data

(60) Provisional application No. 61/906,796, filed on Nov. 20, 2013.

(51) Int. Cl.

| | |
|---|---|
| ***B65D 17/34*** | (2006.01) |
| ***B65D 17/00*** | (2006.01) |
| ***B21D 51/38*** | (2006.01) |

(52) U.S. Cl.

CPC ..... *B65D 17/165* (2013.01); *B21D 51/383* (2013.01); *B65D 17/24* (2013.01); *B65D 2517/0089* (2013.01); *B65D 2517/0094* (2013.01)

(58) Field of Classification Search

CPC ..... B65D 17/165; B65D 2517/0094; B65D 2517/0089; B21D 51/383

USPC ..... 220/269, 271

See application file for complete search history.

(56) References Cited

U.S. PATENT DOCUMENTS

| | | | | |
|---|---|---|---|---|
| 5,219,257 | A | 6/1993 | Koch | |
| 5,555,992 | A | 9/1996 | Sedgeley | |
| 5,829,623 | A | 11/1998 | Otsuka et al. | |
| 6,024,239 | A | 2/2000 | Turner et al. | |
| 7,926,675 | B2 | 4/2011 | Rieck et al. | |
| 8,157,119 | B2 | 4/2012 | Watson et al. | |
| 2004/0065663 | A1 | 4/2004 | Turner et al. | |
| 2008/0011786 | A1* | 1/2008 | Mathabel | B65D 17/165 222/541.9 |

(Continued)

FOREIGN PATENT DOCUMENTS

| | | |
|---|---|---|
| CN | 103140423 | 6/2013 |
| EP | 1072336 | 1/2001 |

(Continued)

OTHER PUBLICATIONS

Official Action for Australia Patent Application No. 2014352940, dated Dec. 12, 2016 3 pages.

(Continued)

*Primary Examiner* — James N Smalley

(74) *Attorney, Agent, or Firm* — Sheridan Ross P.C.

(57) ABSTRACT

An end closure for food and beverage containers is provided. The end closure comprises a score fracture force reduction feature. Thus, less force is required by a user to fracture the score and open the opening in the end closure. In one embodiment, the score fracture force reduction feature is a collapsible form raised above the center panel and having a score line and a coined area.

20 Claims, 8 Drawing Sheets

(56) References Cited

U.S. PATENT DOCUMENTS

| | | | |
|---|---|---|---|
| 2012/0205378 | A1 | 8/2012 | Forrest |
| 2013/0118133 | A1 | 5/2013 | Jacober et al. |

FOREIGN PATENT DOCUMENTS

| | | |
|---|---|---|
| JP | 2000-159229 | 6/2000 |
| JP | 2002-145263 | 5/2002 |
| WO | WO 2011/053776 | 5/2011 |
| WO | WO 2012/143322 | 10/2012 |

OTHER PUBLICATIONS

Official Action for Canada Patent Application No. 2,929,949, dated Apr. 7, 2017 3 pages.
Official Action with English Translation for China Patent Application No. 201480062967.0, dated Mar. 16, 2017 15 pages.
Extended Search Report for European Patent Application No. 14864608.6, dated Feb. 23, 2017 7 pages.
International Search Report and Written Opinion for International (PCT) Patent Application No. PCT/US14/66651, dated Apr. 9, 2015 10 pages.
International Preliminary Report on Patentability for International (PCT) Patent Application No. PCT/US2014/066651, dated Jun. 2, 2016 7 pages.
Notice of Acceptance for Australia Patent Application No. 2014352940, dated Oct. 5, 2017 3 pages.
Official Action with English Translation for China Patent Application No. 201480062967.0, dated Nov. 28, 2017 18 pages.

* cited by examiner

CONTAINER END CLOSURE WITH A SCORE FEATURE

RELATED APPLICATION

This application claims the benefit of U.S. Provisional Patent Application Ser. No. 61/906,796, filed Nov. 20, 2013, entitled "Container End Closure with a Score Feature," which is hereby incorporated by reference in its entirety.

FIELD OF THE INVENTION

Embodiments of the present invention generally relate to containers and container end closures, and more specifically metallic beverage container end closures with a score fracture force reduction feature.

BACKGROUND OF THE INVENTION

Containers, and more specifically metallic beverage containers, generally contain a neck on an upper portion that is adapted for interconnection to a metallic end closure. The container end closure is formed from a flat sheet of metallic material and generally includes a pull tab or other form of stay on tab ("SOT"). Beverage containers commonly store carbonated beverages, thus, both the container body and the container end closure are required to withhold internal pressures up to 90 psi while under varying temperatures without catastrophic failure or permanent deformation. Further, the container end closure must be manufactured, stacked, shipped, and sent to a filler prior to being seamed onto a container body filled with a carbonated beverage. Thus, the container and end closure must be designed to resist deformation and failure while utilizing thin metallic materials and allowing compact stacking during shipping and manufacturing.

Food and beverage containers with pull tabs or SOTs are generally known. Various SOTs and related features are disclosed, by way of example, in U.S. Pat. No. 7,926,675 to Rieck et al., the entire disclosure of which is hereby incorporated by reference in its entirety. SOTs are generally rotated by a user to push on a tear panel that is fractured from the end closure along a score line. The amount of force needed to fracture the score line may be large in order to prevent inadvertent opening of the end closure. Additionally, known end closures may buckle when under varying temperatures and internal pressure. If an end closure buckles near the score line and opening, then the score line can crack and release the contents of the container. This is called "peak and leak." Thus, end closures are often designed to withstand buckling, which generally increases the amount of force a user must exert on the tear panel to fracture the score. Further, many current designs have scores created on a flat panel surface. The flat surface causes springback after the opening load is removed and reduces the area of the opening.

Accordingly, there exists a significant need for a beverage container end closure that will resist buckling, peak and leak, and inadvertent opening while still being easy for a user to open the end closure to access the container's contents.

Previous attempts have been made to manufacture container end closures that reduce the force needed to open the end closure by reducing the score residual (i.e., the material below the score line). However, low score residuals can create transportation leakers as well as stress-cracking issues.

Due to the numerous limitations associated with the prior art described above, the following disclosure describes an improved container end closure that is adapted for interconnection to a container body and that employs a score fracture force reduction feature. This novel feature provides an easy-to-open end closure that also prevents leaking during transportation.

SUMMARY OF THE INVENTION

These and other needs are addressed by the various embodiments and configurations of the present invention. This invention relates to a novel system, device, and method for providing a food and beverage container end closure with a score fracture force reduction feature. The novel end closure provided herein allows the end closure to be easily opened without reducing the score residual.

Features of the present invention may be employed in a wide range of food and beverage containers, including pressurized beverage containers with SOTs secured by a rivet, food containers with tear away lids, and full-panel easy-open end tabs, to name a few. Although the invention generally relates to metallic end closures and containers, the invention and features described herein could easily be implemented on plastic containers and end closures.

Thus, it is one aspect of various embodiments of the present invention to provide a mechanism to create an opening in a container end closure. It is another aspect of some embodiments of the present invention to provide an end closure with a feature that reduces the force required by a user to fracture the score without reducing the score residual depth because low score residuals can create transportation leakers as well as stress-cracking issues. Note that the terms "load" and "force" may be used interchangeably herein.

One aspect of various embodiments of the present invention is to provide an opening where a form feature is collapsed to initiate the fracturing of the score. It is one aspect of embodiments of the present invention to provide a score that is at least partially contained within a form. The form can make it easier for the user to fracture the score and open at least a portion of the end closure, e.g., a tear panel or secondary opening.

It is another aspect of various embodiments of the present invention to provide an end closure where the force required to fracture the score line may be applied to one side of, both sides of, or directly to the score path. Previous designs required that the force be applied to one side of the score path.

One aspect of embodiments of the present invention is to provide a mechanism to create an opening in an end closure, where the opening mechanism does not require any additional tools to create the opening. Thus, a user may use his/her finger or the tab to actuate the score and open the opening. Additionally, the score can be fractured using a downward force on the score area. Alternatively, tools such a keys, coins, or other instruments may be used to fracture the score.

Another aspect of embodiments of the present invention is to provide an opening in a container end closure that reduces the "springback" of the material after the opening load is removed. Springback occurs when bending a piece of sheet metal or other material. The residual stresses in the material will cause the sheet to spring back slightly after the bending operation. Due to this elastic recovery, the final bend radius will be greater than initially formed and the final bend angle will be smaller. With respect to the springback of an opening, the material proximate to the opening sees "full deflection" while the load is applied to the opening area. Once the load is removed, the material springs back to a position less open than when the load was applied. Springback is due to material memory or metal memory. Springback will cause the opening to be smaller than if there was no springback. Thus, it is a further aspect of the present invention to provide an end closure with a larger residual opening. Current designs have scores created on a flat panel surface, which causes springback after the opening load is removed, thus reducing the area of the opening. In some embodiments of the present invention, at least a portion of the score is located on a raised form, not a flat panel surface. By having the score at least partially located on a form, the amount of springback is reduced allowing for a larger residual opening. The residual opening is the opening area after the opening load is removed.

A further aspect of various embodiments of the present invention is to increase the fracturability of the score when an opening force is applied to the opening area. Large amounts of deformation reduce the score's resistance to the force, thus reducing its fracturability. Flat panel surfaces have large amounts of deformation when a load is applied and the deformation is negative because it occurs prior to the score fracturing. Thus, flat panels are less resistant to the load being applied and a score in a flat panel is more difficult to fracture than a score in a non-flat panel. Accordingly, in one embodiment, the score is provided on a non-flat surface, such as a raised form, for example.

It is one aspect of embodiments of the present invention to provide an opening that uses form deflection as an advantage in fracturing the score. Current end closure openings are created on flat panel surfaces, which deflect easily when a load is applied to or near the score path. This deflection reduces the usable stroke of the opening means (for example, a tab, finger, key, etc.) because the score area actually moves away from the load.

A further aspect of some embodiments of the present invention is to provide an opening feature that increases the usable stroke of a lever-like actuating device (e.g., a tab), which reduces the force needed to fracture the score and creates a larger opening area. Many existing tab-actuated opening designs used to open a container are flush to the panel surface and the tab is used as a lever to open the score. In these flat-panel designs, the tab is out of most of its usable stroke prior to fracturing the score. As a result the score opening area is very small. In one embodiment, the score is positioned on a raised form allowing the tab or other lever-like actuating device to have more useable stroke.

Additionally, it is another aspect of embodiments of the present invention to provide an opening where the deformation is localized to only the raised area (e.g., raised form) and the deformation occurs after the score fractures. It is advantageous for the deformation to occur after the score fractures because this type of deformation creates a larger opening. Further, putting at least a portion of the score on a raised form creates more deformation and a larger opening area.

It is one aspect of embodiments of the present invention to provide an end closure with a secondary venting feature or opening. One advantage of some embodiments is that the secondary vent or opening improves pour rate and provides smoother pouring.

It is another aspect of embodiments of the present invention to provide an end closure with a secondary venting feature that is easy to open but that resists internal pressure, leaking during transportation, and peak and leak by using an improved score.

It is another aspect of embodiments of the present invention to provide an end closure with a secondary vent opening that increases the total opening area of the end closure as compared to traditional end closures with only a primary opening.

Another aspect of the present invention is a method for manufacturing an end closure with score fracture force reduction features. More specifically, a method for forming a beverage can end closure is provided, wherein the container end closure is provided with a feature that reduces the force required to open the end closure or an opening in the end closure. In some embodiments, the end closure may have a score positioned on a raised form.

Another aspect of embodiments of the present invention is to provide a container end closure that is manufactured with conventional manufacturing equipment. Additionally, it is one aspect of embodiments to provide a container end closure with a feature that reduces the force required to open the end closure that is manufactured with conventional manufacturing equipment.

In various embodiments, an end closure is provided with a score positioned on a raised form. In some embodiments, the end closure is metallic and can be interconnected to a beverage container. The end closure may also have a SOT or any other tab used in the art.

In one embodiment of the present invention, the end closure comprises a score that is at least partially contained within a form that collapses to initiate score fracture. The collapse causes deformation of the score path primarily in a direction perpendicular to the score path. The form may also encourage collapsing both in the direction of the score path and perpendicular to the score path. In some embodiments, the score is completely contained within the form. In other embodiments, the score is only partially contained within the form. In some embodiments, the form is a raised form and is raised above the center panel of the end closure.

In various embodiments, the score is provided within a raised form. The form area may be coined around the form. The coined areas generate excess metal to be used in the form. The coined areas may also control the amount of formed-in stresses in the score.

In one embodiment, the form is reinforced in one direction (for example, the outward direction to resist internal pressure of the container contents) and weak in another direction (for example, the inward direction such that a user may push on the form to collapse the form inward). In various embodiments, when the form collapses it does not recover its shape such that a permanent opening is created.

The shape of the form (in a top plan view and/or cross-sectional view) may vary from embodiment to embodiment. Thus, in one embodiment the cross-section of the form may have an elongated pyramid shape. In other embodiments, the cross-section of the form may have a dome shape. In one embodiment, the end closure may have a one-sided collapsible form. In additional embodiments, the coined areas may differ such that the coined areas encourage a stronger side, which would rebound after fracture to create an opening. In some embodiments, the form may have an oval shape when viewed from a top plan view. In alternate embodiments, the form may have an oval shape with a circular center portion when viewed from a top plan view. In another embodiment, the form may have an oval shape with wing portions extending from the center of the oval when viewed from a top plan view. In still further embodiments, the form may have a circular or square shape when viewed from a top plan view.

In one embodiment, a metallic end closure with a score fracture force reduction feature is provided. The end closure comprises: a peripheral curl which is adapted for interconnection to a neck of a beverage container; a chuck wall extending downwardly from the peripheral curl; a countersink interconnected to a lower end of the chuck wall; an inner panel wall extending upwardly from an interior portion of the countersink; a center panel interconnected to an upper portion of the inner panel wall, wherein the center panel is oriented in a substantially horizontal plane; a pull tab having a nose end and a tail end which is operably interconnected to the center panel; a first score line in the center panel which defines a first tear panel; and a raised form in the center panel which is elevated above the center panel a predetermined height, wherein a coined area surrounds at least a portion of the raised form, and wherein at least a portion of the first score line is positioned in the raised form. In further embodiments, the metallic end closure comprises a second score line in the center panel, wherein the second score line defines a second tear panel, wherein the first score line and the first tear panel define a vent opening, and wherein the second score line and the second tear panel define a pour opening. In some embodiments, the first score line is substantially contained within the raised form. In additional embodiments, the raised form collapses downwardly when a user excerpts a downward force on the raised form, and wherein a first opening is formed when the raised form collapses downwardly and the first score line fractures. In one embodiment, the raised form has a pyramid-shaped cross-section, and wherein the height of the raised form is at least about 0.010 inches. In various embodiments, the raised form has a rounded dome-shaped cross-section, and wherein the height of the raised form is at least about 0.010 inches. Further, a center of the raised form has a weakened area with a circular shape to promote collapsing of the raised form. Alternatively, the raised form comprises a focalized area near a center of the raised form, and wherein the focalized area has an outwardly extending center point to focus metallic stresses within the focalized area.

In one embodiment, a metallic end closure with a score fracture force reduction feature is provided. The end closure comprises: a horizontal center panel oriented in a substantially horizontal plane; a raised form in the center panel, the raised form having a rectangular shape with rounded ends when viewed from a top plan view and having a dome-shaped cross-section, wherein the raised form is raised above the center panel a height of at least about 0.010 inches; a first coined area positioned between a base of a first side of the dome-shaped raised form and the center panel, the first coined area having a width of at least about 0.030 inches; a second coined area positioned between a base of a second side of the dome-shaped raised form and the center panel, the second coined area having a width of at least about 0.030 inches; and a score line which defines a tear panel, wherein the tear panel is at least partially separable from the center panel to form an opening, and wherein at least a portion of the score line is positioned in a top portion of the raised form. In some embodiments, the score line is substantially contained within the raised form. In various embodiments, the raised form collapses downwardly when a user excerpts a downward force on the raised form, and wherein the opening is formed when the raised form collapses downwardly and the score line fractures. In additional embodiments, the first coined area and the second coined area are interconnected to completely surround the raised form. In further embodiments, the first coined area has a first thickness and the raised form has a second thickness, and wherein the second thickness is greater than the first thickness.

Devices and methods of embodiments of the present invention contemplate forming a collapsible form area by coining or flattening certain areas around the form to generate excess metal. The excess metal can then be formed (e.g., stretched) into the desired form shape. The coins also control the amount of formed-in stresses that exist in the score. At a certain stress level the metal will fail. Both coins and forms add stress to the material. The stress from the forms and coins in embodiments of the present invention allow a lower load to fracture the metal in the form, i.e., fracture the portion of the score positioned within the form.

Various methods of forming an end closure with score fracture force reduction features are provided. In one embodiment, a method is provided comprising the steps of: providing an end closure adapted for interconnection to a neck of a beverage container, the end closure comprising: a peripheral curl; a chuck wall extending downwardly from the peripheral curl; and a center panel interconnected the chuck wall; forming a raised form in the center panel, comprising: coining an area around the raised form to generate excess metal; and forming the excess metal into a form shape, wherein the raised form is raised above the center panel; and providing a score line, wherein at least a portion of the score line is positioned within the raised form. In some embodiments, the end closure further comprises a countersink interconnected to a lower end of the chuck wall; and an inner panel wall extending upwardly from an interior portion of the countersink and interconnected at an upper portion to the center panel. In one embodiment, the method further comprises providing a weakened area in a center portion of the raised form, wherein the weakened area has a circular shape and the weakened area promotes collapsing of the raised form. In additional embodiments, the method further comprises providing a focalized area in a center portion of the raised form, wherein the focalized area has a smaller radius of curvature to concentrate stress within the focalized area. In various embodiments, the raised form has at least one of an oval-shaped, a circular-shaped, a dome-shaped, and a pyramid-shaped cross-section. Further, the at least a portion of the score line positioned within the raised form is positioned proximate to a center of the raised form and positioned near a top of the raised form. Thus, after the form collapses, the form does not recover its shape such that a permanent opening is created.

For purposes of further disclosure, the following references generally related to end panels and SOTs are hereby incorporated by reference in their entireties:

Japanese Patent Publication Number JP2002145263 to Yoshihiko;

Japanese Patent Publication Number JP2000159229 to Yoshihik;

U.S. Pat. No. 5,829,623 issued to Otsuka et al. on Nov. 3, 1998; and

U.S. Pat. No. 8,157,119 issued to Watson et al. on Apr. 17, 2012.

The phrases “at least one”, “one or more”, and “and/or”, as used herein, are open-ended expressions that are both conjunctive and disjunctive in operation. For example, each of the expressions “at least one of A, B and C”, “at least one of A, B, or C”, “one or more of A, B, and C”, “one or more of A, B, or C” and “A, B, and/or C” means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
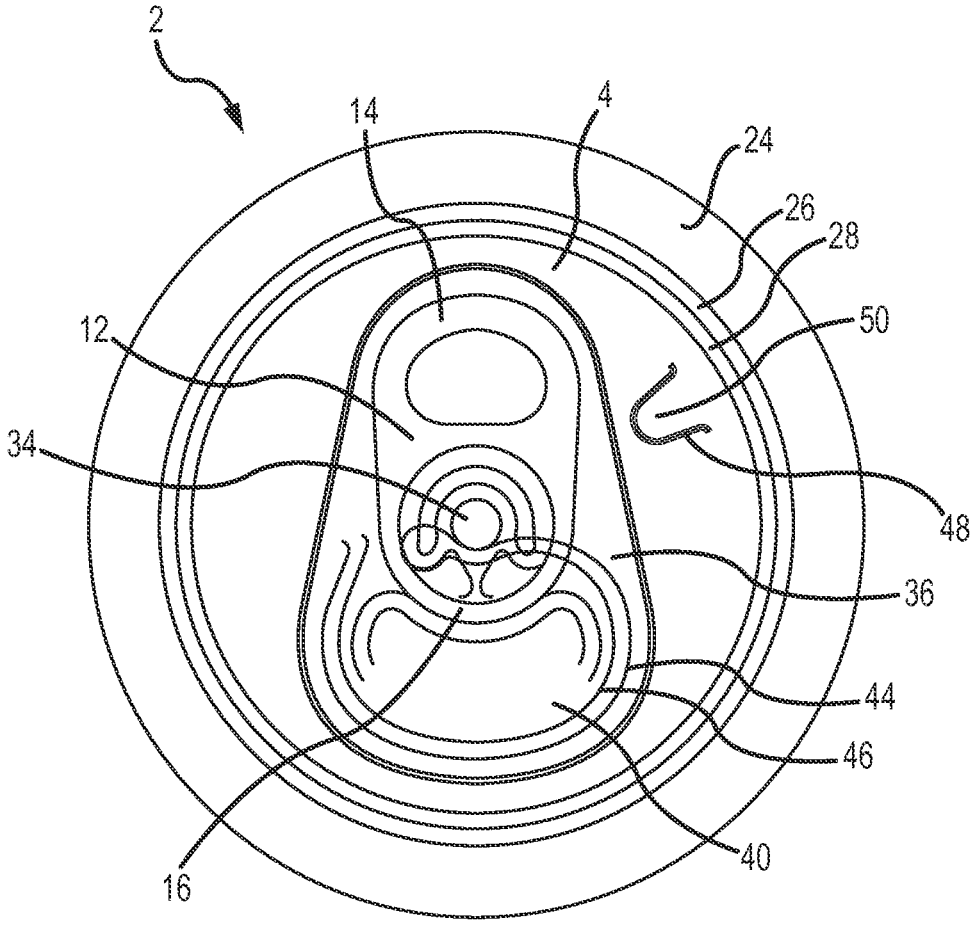
FIG. 1 shows the public side of one embodiment of an end closure with a stay on tab and a vent opening.

To assist in the understanding of the embodiments of the present invention the following list of components and associated numbering found in the drawings is provided herein:

| Component No. | Component |
|---|---|
| 2 | End Closure |
| 4 | Center Panel |
| 6 | Load |
| 8 | Deformation Direction |
| 12 | Tab |
| 14 | Tail (End of Tab) |
| 16 | Nose (End of Tab) |
| 18 | Lift Ring |
| 24 | Peripheral Curl |
| 26 | Chuck Wall |
| 28 | Countersink |
| 30 | Form (Area) |
| 32 | Form Perimeter |
| 34 | Rivet |
| 36 | Deboss Area |
| 38 | Score Line (before opening) |
| 38A | Score Line (after opening) |
| 40 | (Primary) Tear Panel |
| 44 | Primary Score Line |
| 46 | Secondary Score Line |
| 48 | Vent Score Line |
| 50 | Secondary Tear Panel |
| 54 | Focalized Area (of Form) |
| 56 | Weakened Area (of Form) |
| 58 | First Coined Area |
| 60 | Second Coined Area |
| 62 | Vertical Side of Form |
| 64 | Curved Side of Form |
| W1 | Width of Form |
| W2 | Width of First Coin Area |
| W3 | Width of Second Coin Area |
| H1 | Height of Form (before load) |
| A1 | Angle of the Form |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict metal end closures, container bodies, scores, score fracture force reduction features, and methods and systems for using the same, the present invention is not limited to these embodiments. It should also be understood that the terms "container" and "container body"; "end closure" and "container end closure"; "tear panel" and "tear portion"; "opening" and "pour opening"; and "main" and "primary" may be used interchangeably in some instances.

FIG. 1 shows the public side of one embodiment of an end closure 2 with a tab 12, center panel 4, a pour opening, and a vent opening. The end closure 2 comprises a peripheral curl 24 interconnected to a chuck wall 26, which is interconnected on a lower end to a countersink 28. The center panel 4 comprises a deboss area 36, a primary tear panel 40 defined by a primary score line 44, and a secondary tear panel 50 defined by a vent score line 48. The primary tear panel 40 also includes a secondary score line 46, which is parallel to the primary score line 44. The pour opening is created after the primary score line 44 is fractured and the primary tear panel 40 separates from the center panel 4. The vent opening is created after the vent score line 48 is fractured and the secondary tear panel 50 separates from the center panel 4. The tab 12 is interconnected to the center panel 4 via a rivet 34. The tab 12 has a pull end or a tail end 14 opposite a nose end 16.

Figure 2:
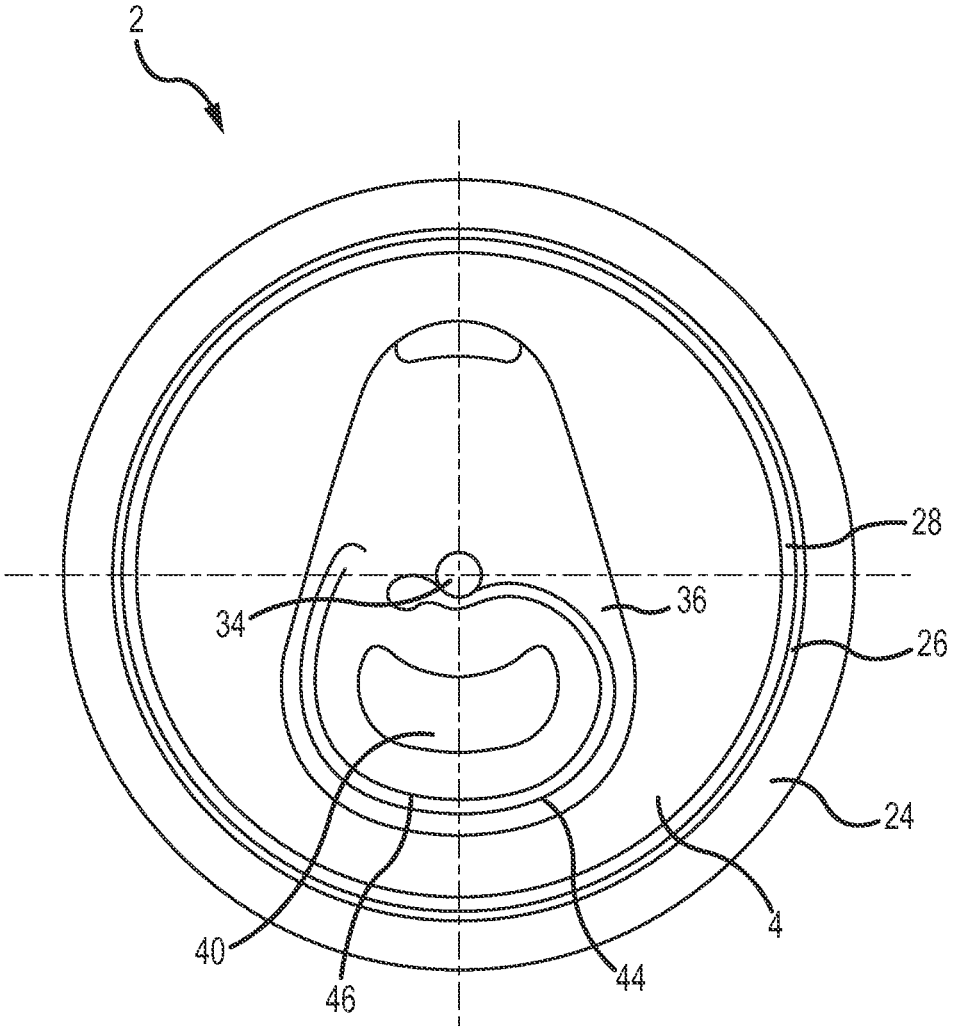
FIG. 2 shows the public side of a second embodiment of an end closure.

FIG. 2 shows the public side of a second embodiment of an end closure 2. The end closure 2 is shown without a tab. The end closure 2 comprises a peripheral curl 24 interconnected to a chuck wall 26, which is interconnected on a lower end to a countersink 28. The countersink 28 is interconnected to a center panel 4, which includes a rivet 34, a deboss area 36, and a tear panel 40 defined by a primary score line 44. The tear panel 40 also has a secondary score line 46 that is parallel to the primary score line 44.

Figure 3A:
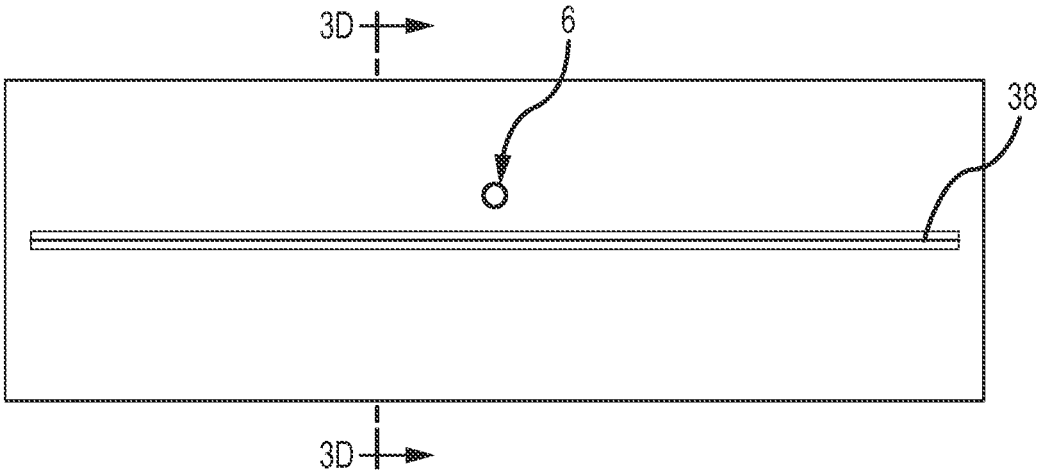
FIG.3A PRIOR ART
FIGS. 3A-D show the score line of an end closure of the prior art.
Figure 3B:
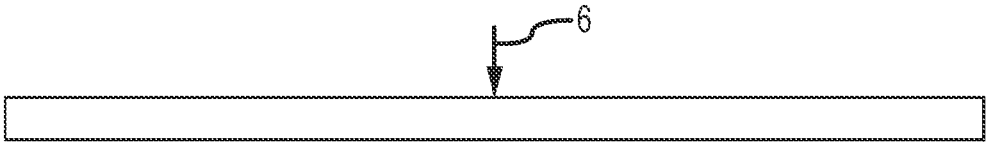
FIG.3B PRIOR ART
Figure 3C:
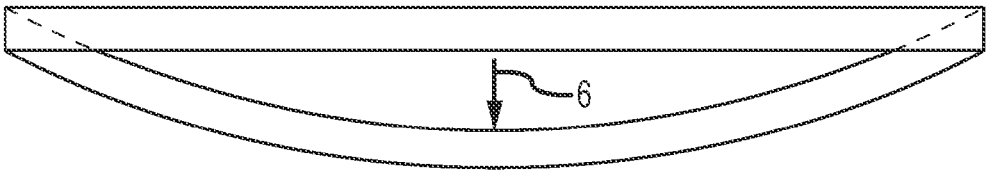
FIG.3C PRIOR ART
Figure 3D:
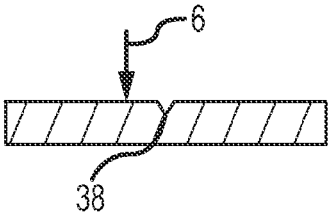
FIG.3D PRIOR ART

FIGS. 3A-3D show a score line of existing designs. FIG. 3A shows a top plan view of the score line 38 and a load 6 positioned proximate to the score line 38. FIG. 3B a side elevation view of the material with the score before the load 6 is applied near the score. FIG. 3C shows a side elevation view of the material with the score after the load 6 is applied near the score. FIG. 3D shows a sectional view of the material with the score line 38 at cut 3D-3D of FIG. 3A.

Figure 4A:
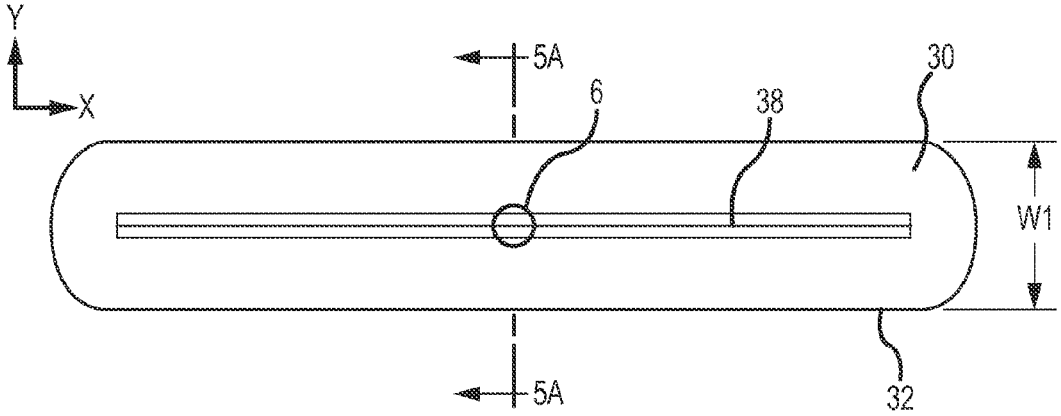
FIGS. 4A-C show various views of one embodiment of a score line within a form.

FIG. 4A shows a top plan view of one embodiment of a score line 38 positioned within a form 30 having a width W1 and defined by a form perimeter 32. In one embodiment, W1 ranges between approximately 0.100 inches and 0.600 inches. In a more preferred embodiment, W1 ranges between approximately 0.150 inches and 0.500 inches. In a more preferred embodiment, W1 ranges between approximately 0.200 inches and 0.400 inches. In one embodiment, the form 30 has a rectangular shape with rounded ends, such that the form 30 is longer than it is wide. The score 38 may be contained within the form 30 or only a part of the score 38 may be contained within the form 30. FIG. 4A shows the form 30 and score line 38 prior to applying an opening load 6 to the score line 38. The x-direction and y-direction are shown in FIG. 4A.

Figure 4B:
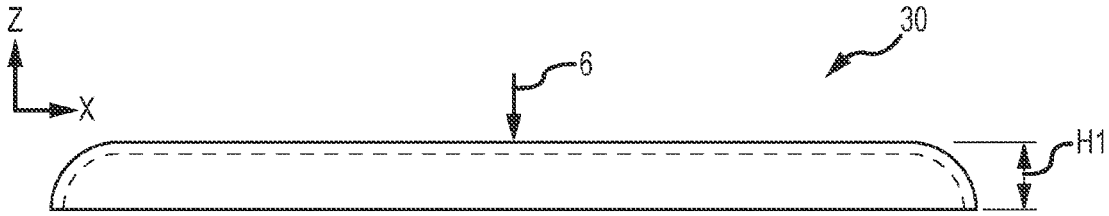

FIG. 4B is a side elevation view of the form 30 with a height H1 prior to applying the force 6. H1 is measured from the base of the form 30 to the top of the form 30. The form 30 is raised above the center panel a height, which may be H1 in some embodiments. In other embodiments, the form 30 is positioned in the deboss area of the center panel, and therefore H1 is height of the form above the deboss area. The dotted line shows the thickness of the form 30 according to one embodiment. The x-direction and z-direction are shown in FIG. 4B. In one embodiment, H1 ranges between approximately 0.005 inches and 0.050 inches. In a more preferred embodiment, H1 ranges between approximately 0.010 inches and 0.030 inches. In a most preferred embodiment, H1 ranges between approximately 0.015 inches and 0.025 inches.

Figure 4C:
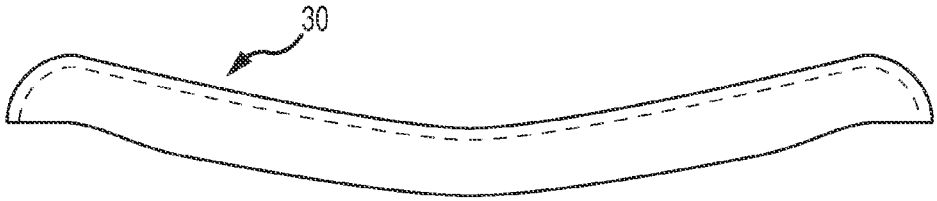

FIG. 4C is a side elevation view of the form 30 after the opening load 6 is applied in a downward (negative Z) direction. The center of the form 30 collapses downward in the direction of the applied force. The dotted line shows the thickness of the form 30 in cross-section.

Figure 5A:
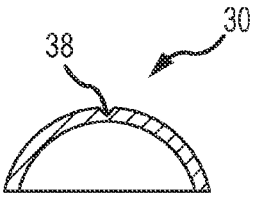
FIG. 5A shows a cross-sectional view of the score line within the form of FIGS. 4A-B.
Figure 5B:
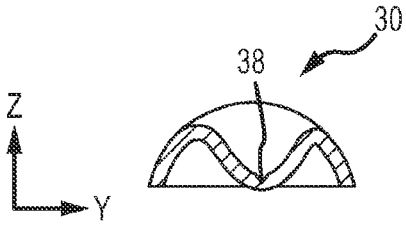
FIG. 5B shows a cross-sectional view of the score line within the form of FIG. 4C.

FIG. 5A shows a cross-sectional view of section 5A-5A of the form 30 of FIG. 4A before the load 6 is applied to the form 30. The form 30 includes a score line 38 proximate to the center of the form 30. FIG. 5B shows a cross-sectional view of section 5A-5A of the form 30 after the load 6 is applied to the form 30, but immediately before the score 38 fractures. After the score 38 fractures, the cross-section would look similar, except that the score 38 would be fractured, thus creating a gap in the metal at the score 38 location. As can be seen from FIGS. 4C and 5B, the form 30 has a permanently deformed shape after the downward force 6 is applied to the form 30. Specifically, the form 30 has collapsed near the center of the form 30 along the length of the form 30 (FIG. 4C) and along the width of the form 30 (FIG. 5B). Thus, the form 30 encourages collapsing in two directions: along the score line 38 (x-direction) and perpendicular to the score line 38 (y-direction). Although FIGS. 4A-5B show the score as linear, the score may be any shape or combination of shapes known in the art. Thus, the score line can be curved as shown in FIGS. 1 and 2 (item numbers 44, 46, and 48). Additionally, the form and score may be associated with a primary opening, secondary opening, secondary vent feature, or any other opening.

Figure 6A:
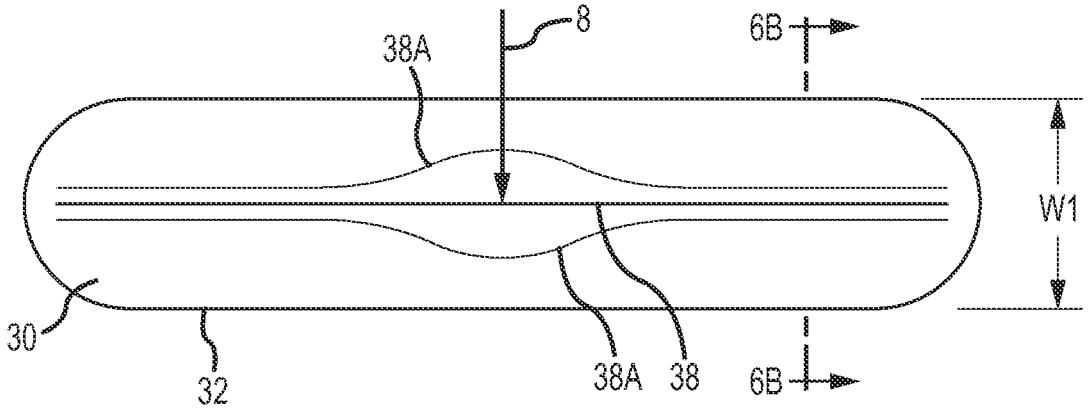
FIG. 6A shows a top plan view of the score line within the form of FIG. 4A before and after the score has been fractured.
Figure 6B:
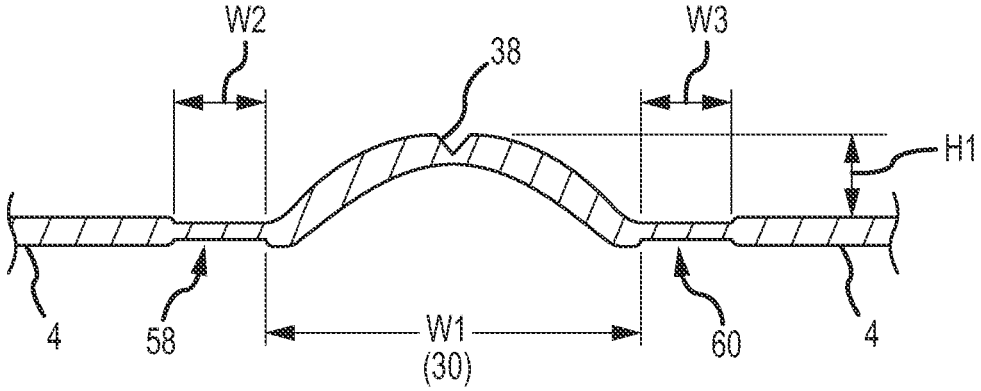
FIG. 6B shows section VI-VI of the form of FIG. 6A.
Figure 7:
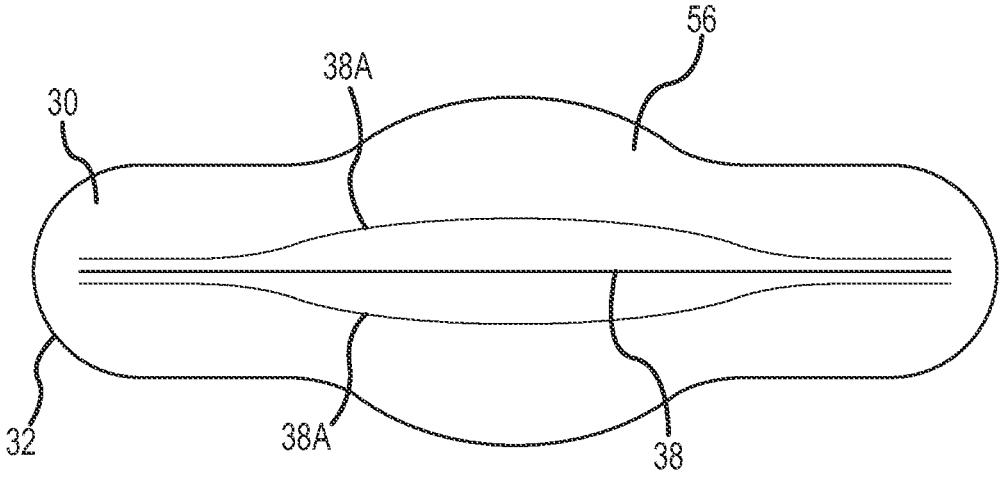
FIG. 7 shows a top plan view of a second embodiment of a form with a score line before and after the score has been fractured.
Figure 8A:
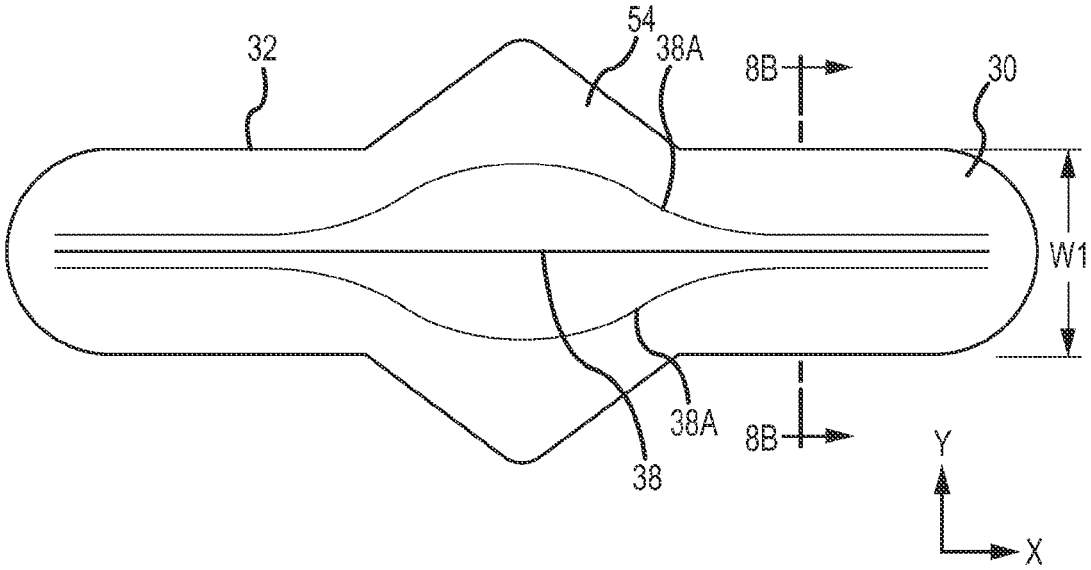
FIG. 8A shows a top plan view of a third embodiment of a form with a score line before and after the score has been fractured.

FIGS. 6A, 7, and 8A show three embodiments of the form area 30 in top plan view. Specifically, FIG. 6A shows one embodiment of the form 30 with a width W1 and defined by a form perimeter 32. In one embodiment, W1 ranges between approximately 0.100 inches and 0.600 inches. In a more preferred embodiment, W1 ranges between approximately 0.150 inches and 0.500 inches. In a most preferred embodiment, W1 ranges between approximately 0.200 inches and 0.400 inches. This embodiment of the form 30 has a long, cylindrical, tube shape. FIG. 6A shows the score line 38 before an opening load is applied to the score 38 and before the score 38 is fractured Additionally, FIG. 6A shows the score lines 38A after the load has been applied and after the score 38A has been fractured to create the opening. The arrow 8 shows the deformation direction perpendicular to the score 38 path. Note that the coined areas 58, 60 shown in FIG. 6B are not shown in FIG. 6A. However, the coined areas 58, 60 are positioned just outside of the form perimeter 32 of FIG. 6A.

FIG. 6B shows a cross-section of the embodiment of the form 30 of FIG. 6A at cut 6B-6B. This embodiment has a collapsible form 30 with a dome-shaped cross-section having a height H1 and a form area 30. In one embodiment, H1 ranges between approximately 0.005 inches and 0.050 inches. In a more preferred embodiment, H1 ranges between approximately 0.010 inches and 0.030 inches. In a most preferred embodiment, H1 ranges between approximately 0.015 inches and 0.025 inches. The form 30 comprises a score line 38 positioned proximate to the center of the form 30 and near the top of the form 30. The form 30 has a width W1. In one embodiment, W1 ranges between approximately 0.100 inches and 0.600 inches. In a more preferred embodiment, W1 ranges between approximately 0.150 inches and 0.500 inches. In a more preferred embodiment, W1 ranges between approximately 0.200 inches and 0.400 inches. Either side of the form dome has a coined area: a first coined area 58 having a width W2 and a second coined 60 having a width W3. In one embodiment, W2 ranges between approximately 0.020 inches and 0.200 inches. In a more preferred embodiment, W2 ranges between approximately 0.030 inches and 0.150 inches. In a most preferred embodiment, W2 ranges between approximately 0.040 inches and 0.100 inches. In one embodiment, W3 ranges between approximately 0.020 inches and 0.200 inches. In a more preferred embodiment, W3 ranges between approximately 0.030 inches and 0.150 inches. In a most preferred embodiment, W3 ranges between approximately 0.040 inches and 0.100 inches. The center panel 4 is shown outside of the two coined areas 58, 60. The two coined areas 58, 60 may be the same width, thickness, and strength in one embodiment. In another embodiment, the two coined areas 58, 60 may have different widths W2, W3, thicknesses, and/or strengths. Thus, the coined areas 58, 60 may differ such that the coined areas 58, 60 encourage a stronger side, which would rebound after fracture to create an opening. Additionally, the coined areas 58, 60 can vary to promote fracture of the score 38 and rebounding of one side of the form 30.

FIG. 7 shows a top plan view of a second embodiment of a score 38 contained within a form 30 having a width W1 and defined by a form perimeter 32. Here, the center of the form 30 has been softened (i.e., has bigger radii) to allow the form 30 to collapse easier than the form shown in FIG. 6A. Because the form 30 is designed to receive a load proximate to the center of the form 30, the softened geometry provides a form 30 that collapses easier in the area of loading than in other areas. The form 30 includes a weakened area 56, which is the form area 56 with a larger radius. The score line 38 is shown before an opening load is applied to the score 38 and before the score 38 is fractured. The score line 38A is also shown after the load has been applied and after the score 38A has been fractured to create the opening. Although a cross-section of FIG. 7 is not shown, the cross-section of the embodiment shown in FIG. 7 may be the same as the cross-section shown in FIG. 6B when the form 30 of FIG. 7 is cut at the same location as the form 30 of FIG. 6A. However, if the cross-section of FIG. 7 is taken at the center of the form 30 (i.e., where the form 30 is the widest and proximate to the weakened area 56), then the cross-section will look similar to the cross-section shown in FIG. 6B, but W1 would be wider.

Figure 8B:
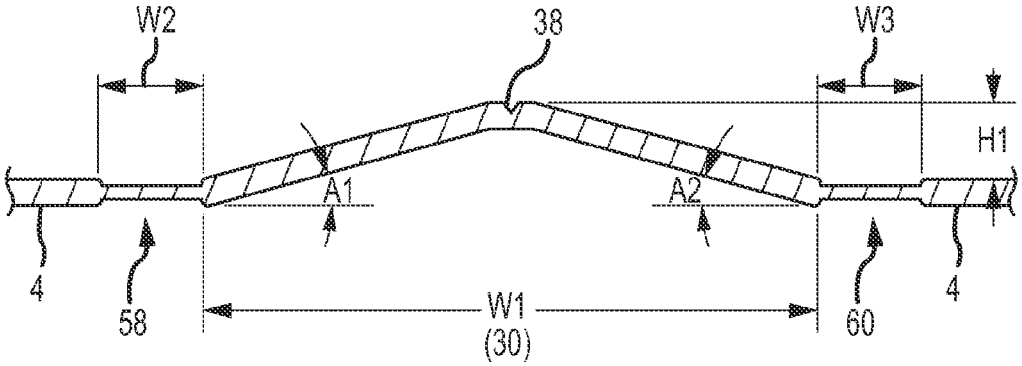
FIG. 8B shows section VIII-VIII of the form of FIG. 8A.

FIG. 8A shows a top plan view of a third embodiment of the form 30 with a width W1 and defined by a form perimeter 32. In one embodiment, W1 ranges between approximately 0.100 inches and 0.600 inches. In a more preferred embodiment, W1 ranges between approximately 0.150 inches and 0.500 inches. In a most preferred embodiment, W1 ranges between approximately 0.200 inches and 0.400 inches. This form 30 has a focalized area 54 near the center of the form 30, where the features have been sharpened (i.e., smaller radii) to focus the forces and loads into the center of the form 30. The focalized area 54 acts like a stress concentrator to promote permanent deformation of the form 30. When a load is applied to a structure, the load causes the structure to stress. A stress concentrator forces the stress to be higher in a specific, focalized area. By focusing all of the stress to a small area, the small area will fail sooner than it would fail without the concentrated stress. Thus, when a load is applied to the form 30, the stress on the form is concentrated in the focalized area 54 and the form 30 will fail sooner and the score 38 will fracture sooner than the form 30 would fail and the score would fracture without the focalized area 54. In some embodiments, the focalized area may have an outwardly extending center point. The score line 38 is shown before an opening load is applied to the score 38 and before the score 38 is fractured. The score line 38A is also shown after the load has been applied and after the score 38A has been fractured to create the opening. Note that the coined areas 58, 60 shown in FIG. 8B are not shown in FIG. 8A. However, the coined areas 58, 60 are positioned just outside of the form perimeter 32 of FIG. 8A.

FIG. 8B shows a cross-sectional view of the form 30 of FIG. 8A at cut 8B-8B. This embodiment has a collapsible form 30 with an elongated pyramid-shaped cross-section having a height H1 and a score 38 near the center and/or top of the form 30. In one embodiment, H1 ranges between approximately 0.005 inches and 0.050 inches. In a more preferred embodiment, H1 ranges between approximately 0.010 inches and 0.030 inches. In a most preferred embodiment, H1 ranges between approximately 0.015 inches and 0.025 inches. The form 30 has a width W1. In one embodiment, W1 ranges between approximately 0.100 inches and 0.600 inches. In a more preferred embodiment, W1 ranges between approximately 0.150 inches and 0.500 inches. In a most preferred embodiment, W1 ranges between approximately 0.200 inches and 0.400 inches. The flatter angle A1, A2 of the form 30 has a weaker structure. In one embodiment, the angles A1, A2 are approximately the same angle. In another embodiment, the angle A1 is different than the angle A2. In some embodiments, the angles A1, A2 are between about 5 and 45 degrees. In a preferred embodiment, the angles A1, A2 are about 30 degrees. Either side of the pyramid-shaped form 30 has a coined area: a first coined area 58 having a width W2 and a second coined 60 having a width W3. In one embodiment, W2 ranges between approximately 0.020 inches and 0.200 inches. In a more preferred embodiment, W2 ranges between approximately 0.030 inches and 0.150 inches. In a most preferred embodiment, W2 ranges between approximately 0.040 inches and 0.100 inches. In one embodiment, W3 ranges between approximately 0.020 inches and 0.200 inches. In a more preferred embodiment, W3 ranges between approximately 0.030 inches and 0.150 inches. In a most preferred embodiment, W3 ranges between approximately 0.040 inches and 0.100 inches. The center panel 4 is shown outside of the two coined areas 58, 60. The two coined areas 58, 60 may be the same width, thickness, and strength in one embodiment. In another embodiment, the two coined areas 58, 60 may have different widths W2, W3, thicknesses, and/or strengths. Thus, the coined areas 58, 60 may differ such that the coined areas 58, 60 encourage a stronger side, which would rebound after fracture to create an opening.

Figure 9:
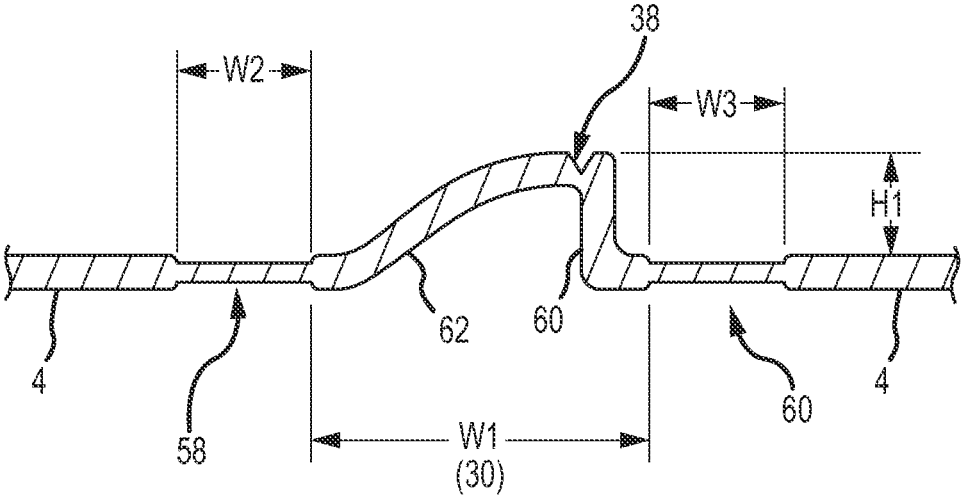
FIG. 9 shows a cross-sectional view of a fourth embodiment of a form with a score line.

FIG. 9 shows the cross-section of a fourth embodiment of a form 30 with a score line 38. This embodiment has a one-sided collapsible form 30 with a non-symmetrical cross-section having a height H1, width W1, and a form area 30. In one embodiment, W1 ranges between approximately 0.100 inches and 0.600 inches. In a more preferred embodiment, W1 ranges between approximately 0.150 inches and 0.500 inches. In a most preferred embodiment, W1 ranges between approximately 0.200 inches and 0.400 inches. In one embodiment, H1 ranges between approximately 0.005 inches and 0.050 inches. In a more preferred embodiment, H1 ranges between approximately 0.010 inches and 0.030 inches. In a most preferred embodiment, H1 ranges between approximately 0.015 inches and 0.025 inches. The form cross-section has one substantially vertical side 60 and a curved side 62. The form 30 also has a score line 38 and two coined areas: a first coined area 58 having a width W2 and a second coined 60 having a width W3. In one embodiment, W2 ranges between approximately 0.020 inches and 0.200 inches. In a more preferred embodiment, W2 ranges between approximately 0.030 inches and 0.150 inches. In a most preferred embodiment, W2 ranges between approximately 0.040 inches and 0.100 inches. In one embodiment, W3 ranges between approximately 0.020 inches and 0.200 inches. In a more preferred embodiment, W3 ranges between approximately 0.030 inches and 0.150 inches. In a most preferred embodiment, W3 ranges between approximately 0.040 inches and 0.100 inches. The center panel 4 is shown outside of the two coined areas 58, 60. The two coined areas 58, 60 may be the same width, thickness, and strength in one embodiment. In another embodiment, the two coined areas 58, 60 may have different widths W2, W3, thicknesses, and/or strengths. Thus, the coined areas 58, 60 may differ such that the coined areas 58, 60 encourage a stronger side, which would rebound after fracture to create an opening. The score 38 is positioned in the form 30 such that one side 60 is stiffened by the form shape, which reduces the force required to fracture the score 38 and open the opening. Generally, the substantially straight and vertical side 60 will be stiffer than the curved side 62. The stiffened side 60 of the form 30 also prevents one side 60 of the form 30 from collapsing completely, thus creating a larger opening. This is because the stiffened side 60 does not deform. Thus, the curved side 62 collapses and the substantially vertical side 60 remains in its original position, which means all of the load is applied to only one side of the form, thereby causing more permanent deformation.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A metallic end closure with a score fracture force reduction feature, comprising:

a peripheral curl which is adapted for interconnection to a neck of a beverage container;

a chuck wall extending downwardly from said peripheral curl;

a countersink interconnected to a lower end of said chuck wall;

an inner panel wall extending upwardly from an interior portion of said countersink;

a center panel interconnected to an upper portion of said inner panel wall, wherein said center panel is oriented in a substantially horizontal plane;

a pull tab having a nose end and a tail end which is operably interconnected to said center panel;

a first score line in said center panel which defines a first tear panel; and a raised form in said center panel which is elevated above said center panel a predetermined height, wherein a coined area surrounds at least a portion of said raised form, and wherein said first score line is substantially contained within said raised form.

2. The metallic end closure of claim 1, further comprising a second score line in said center panel, wherein said second score line defines a second tear panel.

3. The metallic end closure of claim 2, wherein said first score line and said first tear panel define a vent opening, and wherein said second score line and said second tear panel define a pour opening.

4. The metallic end closure of claim 1, wherein said raised form collapses downwardly when a user exerts a downward force on said raised form, and wherein a first opening is formed when said raised form collapses downwardly and said first score line fractures.

5. The metallic end closure of claim 1, wherein said raised form has a pyramid-shaped cross-section, and wherein said height of said raised form is at least about 0.010 inches.

6. The metallic end closure of claim 1, wherein said raised form has a rounded dome-shaped cross-section, and wherein said height of said raised form is at least about 0.010 inches.

7. The metallic end closure of claim 1, wherein a center of said raised form has a weakened area with a circular shape to promote collapsing of said raised form.

8. The metallic end closure of claim 1, wherein said raised form comprises a focalized area near a center of said raised form, and wherein said focalized area has an outwardly extending center point to focus metallic stresses within said focalized area.

9. A metallic end closure with a score fracture force reduction feature, comprising:

a horizontal center panel oriented in a substantially horizontal plane;

a raised form in said center panel, said raised form having a rectangular shape with rounded ends when viewed from a top plan view and having a dome-shaped cross-section, wherein said raised form is raised above said center panel a height of at least about 0.010 inches;

a first coined area positioned between a base of a first side of said dome-shaped raised form and said center panel, said first coined area having a width of at least about 0.030 inches, wherein said first coined area has a first thickness and said raised form has a second thickness, and wherein said second thickness is greater than said first thickness;

a second coined area positioned between a base of a second side of said dome-shaped raised form and said center panel, said second coined area having a width of at least about 0.030 inches; and a score line which defines a tear panel, wherein said tear panel is at least partially separable from said center panel to form an opening, and wherein at least a portion of said score line is positioned in a top portion of said raised form.

10. The metallic end closure of claim 9, wherein said score line is substantially contained within said raised form.

11. The metallic end closure of claim 9, wherein said raised form collapses downwardly when a user exerts a downward force on said raised form, and wherein said opening is formed when said raised form collapses downwardly and said score line fractures.

12. The metallic end closure of claim 9, wherein said first coined area and said second coined area are interconnected to completely surround said raised form.

13. A metallic end closure with a score fracture force reduction feature, comprising:

a peripheral curl which is adapted for interconnection to a neck of a beverage container;

a chuck wall extending downwardly from said peripheral curl;

a countersink interconnected to a lower end of said chuck wall;

an inner panel wall extending upwardly from an interior portion of said countersink;

a center panel interconnected to an upper portion of said inner panel wall, wherein said center panel is oriented in a substantially horizontal plane;

a pull tab having a nose end and a tail end which is operably interconnected to said center panel;

a first score line in said center panel which defines a first tear panel;

a second score line in said center panel, wherein said second score line defines a second tear panel; and a raised form in said center panel which is elevated above said center panel a predetermined height, wherein a coined area surrounds at least a portion of said raised form, and wherein at least a portion of said first score line is positioned in said raised form.

14. The metallic end closure of claim 13, wherein said first score line and said first tear panel define a vent opening, and wherein said second score line and said second tear panel define a pour opening.

15. The metallic end closure of claim 13, wherein said first score line is substantially contained within said raised form.

16. The metallic end closure of claim 13, wherein said raised form collapses downwardly when a user exerts a downward force on said raised form, and wherein a first opening is formed when said raised form collapses downwardly and said first score line fractures.

17. The metallic end closure of claim 13, wherein said raised form has a pyramid-shaped cross-section, and wherein said height of said raised form is at least about 0.010 inches.

18. The metallic end closure of claim 13, wherein said raised form has a rounded dome-shaped cross-section, and wherein said height of said raised form is at least about 0.010 inches.

19. The metallic end closure of claim 13, wherein a center of said raised form has a weakened area with a circular shape to promote collapsing of said raised form.

20. The metallic end closure of claim 13, wherein said raised form comprises a focalized area near a center of said raised form, and wherein said focalized area has an outwardly extending center point to focus metallic stresses within said focalized area.

* * * * *